United States Patent [19]

Kaltenegger

[11] Patent Number: 4,662,779

[45] Date of Patent: May 5, 1987

[54] ROAD ROLLER

[76] Inventor: Benno Kaltenegger, Aug dem hohen Ufer 14, D-5205 St. Augustin 3, Fed. Rep. of Germany

[21] Appl. No.: 770,992

[22] Filed: Aug. 30, 1985

[30] Foreign Application Priority Data

Sep. 12, 1984 [DE] Fed. Rep. of Germany ..... 3433385

[51] Int. Cl.[4] ..... E21C 19/26

[52] U.S. Cl. ..... 404/125; 404/122; 404/126

[58] Field of Search ..... 404/103, 117, 122, 123, 404/125, 126

[56] References Cited

U.S. PATENT DOCUMENTS 3,403,610 10/1968 Kaltenegger ..... 404/127

3,947,142 3/1976 Takata et al. ..... 404/126

*Primary Examiner*—Stephen J. Novosad

*Assistant Examiner*—Thomas J. Odar

*Attorney, Agent, or Firm*—Diller, Ramik & Wight

[57] ABSTRACT

A road roller includes a pair of rotatable roller drums each having axially opposite end portions and an axis of rotation, the roller drums pivot between a first position at which the roller drums are generally in line with the direction of travel with the axes thereof generally parallel and a second position at which the roller drums are generally laterally offset relative to each other in the direction of travel, the pivoting is effected by a generally vertical pivot axis lying in the plane of the axis of rotation of one of the roller drums and adjacent one of its axial end portions, a pair of frames positioned one relative to each of the roller drums and having opposite first and second end portions, a carrier position in the direction of travel and generally transversely to the axes of rotation of the roller drums in the first and second positions, the carrier having opposite end portions, one of the carrier end portions being connected at the vertical pivot axis to the first end portion of one of the roller drum frames, and a second of the carrier end portions being permanently rigidly fixed to the first end portion of the other of the frames.

25 Claims, 4 Drawing Figures

ROAD ROLLER

This invention is directed to a novel road roller having rotatable roller drums positioned substantially entirely one behind the other in the direction of travel, yet being capable of lateral offset relationship to each other through relative pivotal movement about a generally vertical pivot axis.

Efforts have been made to improve the maneuverability of road rollers by offsetting the roller drums thereof relative to each other. Thus, instead of the roller drums being directly in line with each other in the direction of travel and in complete overlap, the drums are relatively laterally offset so that the overlap therebetween is not total. This is effected in one conventional road roller through the utilization of a frame having a central spar between the roller drums and transverse to the direction of travel or motion. Legs are rigidly connected to the central spar and project from laterally opposite sides thereof. These legs carry the roller drums.

In another conventional road roller having offset roller drums, the frame thereof is formed of two generally U-shaped sections located in one plane behind one another. The U-shaped sections are arranged in opposed relationship to each other with the outer legs thereof serving as bearing axles for the roller drums. The roller drums can either be rigidly connected to the frame or they can be arranged to be swung relative to each other. Obviously, since the frame is located between the roller drums, especially in the case of a transverse spar of the frame, the roller drums are located at a considerable distance from one another resulting in a rather bulky construction of this type of road roller. Such bulky road rollers are expensive simply because of the excessive material required for the greater length thereof. In addition, the overlapping of the roller drums in the direction of travel or motion is rather considerable so the effective overall width or lateral extent of the road roller relative to the length of each individual roller drum is only slightly increased. Furthermore, road rollers of this type can only be turned through relatively larger radius turns.

In keeping with the foregoing it is a primary object of the present invention to provide a novel road roller in which the roller drums can be arranged in laterally offset relationship to each other with relatively little overlap in the direction of motion or travel, and the construction is such as to enable the road roller to be converted from this broad-track lateral arrangement to a tandem arrangement in a rapid and simple manner. The road roller of the present invention distinguishes over those first-mentioned conventional road rollers in that a vertical turning axis of one of the roller drums is in a perpendicular or vertical plane which passes through the longitudinal axis or axle of this roller drum and is close to one of the axial drum ends thereof.

In keeping with the present invention, because the vertical pivot passes through a vertical plane which also passed through the axis of the one roller drum adjacent one of the axial ends of the roller drum, the roller drums can be arranged in tandem one-behind-the-other, yet can be moved to a laterally offset or broad-track arrangement with partial though limited overlap between the two roller drums, thus making certain that there is no unworked central strip, as in conventional road rollers of this type. The one roller drum is preferably pivotally supported such that it can be pivoted through at least 180° so that the two rollers can lie one behind the other (tandem) in generally full overlap, or can be relatively pivoted to the broad-track arrangement or any position therebetween to permit the road roller to turn along a variety of different (and abrupt) curves. Therefore, through but a single vertical pivot lying in the planes aforesaid the roller drum achieves all possible maneuverability required and can be virtually "turned on-the-spot". Furthermore, the pivotal construction also permits the roller drums to be relatively pivoted during virtually any direction of turn and at virtually any turning speed within the operable ranges of the road roller.

In keeping with the present invention each roller drum preferably includes an associated frame rotatably supporting an associated roller drum, a carrier spanning the frames and being connected thereto with the carrier axis being generally normal to the rotational axes of the roller drums when the latter are in generally parallel relationship to each other in either the tandem or broad-track or laterally offset arrangements. The vertical pivot or turning axle is part of one of the connections between the carrier and one of the frames and in lieu of simply being a vertical pivot, it can as well be a universal joint.

In further accordance with this invention, the carrier of the road roller is longitudinally displaceable such that the distance between the two roller drums can be varied. In this way when the carrier is extended so that the distance between the two roller drums is at a maximum, one of the roller drums can be pivoted from the broad-track to the tandem arrangement or vice versa through an angle of 180°, and if necessary, up to 200° or more. In the absence of longitudinally displacing the roller drums from each other through the carrier such high arcuate range of pivoting would be appreciably reduced, thus reducing the overall efficiency of the road roller. Furthermore, since the carrier can space the roller drums a considerable distance away from each other to effect pivoting up to and through 270° the maneuverability of the road roller is correspondingly increased. The same considerable arcuate movement increases the arcuate distance between the starting/ending points of pivotal movement of the associated roller drums between the broad track and tandem arrangements thereof. From these lateral arrangements it is possible to pivot out the pivoted roller in one direction or another to steer through curves of great or small radiuses.

Preferably, the carrier of the invention is shifted by the means of a pressure medium, such as hydraulic fluid operating in a fluid motor (piston-cylinder). However, the carrier can be equally adjusted by means of a threaded spindle operated by a crank within a threaded bore, such that upon turning the crank the carrier length can be increased or decreased by relative rotation of the threaded spindle relative to the threaded bore.

In further accordance with this invention, the vertical pivot lies not only in the plane of the axis of rotation of one of the rollers, but also in the plane of longitudinal movement of the carrier which effectively produces general universal adjustment of the one drum relative to the other drum for travelling either straight ahead or around curves.

In further accordance with the present invention, each roller drum of the road roller includes an independent drive mechanism for rotating the roller drum and an independent mechanism for imparting vibration thereto. This improves the ease of operation, mobility and control of the overall road roller. Preferably, the driving mechanisms are hydraulic motors which are fed by a hydraulic pump driven by an internal combustion engine. Both the drive mechanisms for the roller drums and for vibrating the same are carried by laterally depending support plates of the frames adjacent the carrier. In this manner, the opposite axially ends of the roller drums remote from the carrier can be driven tight along walls in both the broad-track and tandem arrangements.

With the above and other objects in view that will hereinafter appear, the nature of the invention will be more clearly understood by reference to the following detailed description, the appended claims and the several views illustrated in the accompanying drawings.

Figure 1:
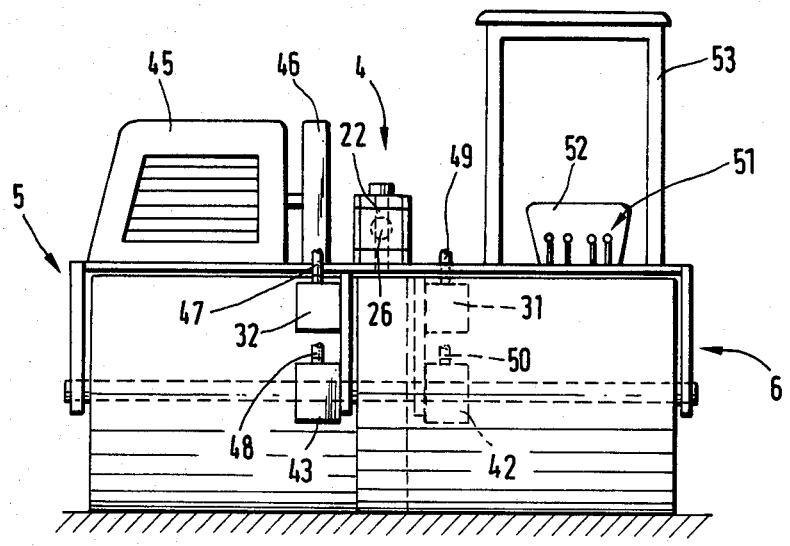
FIG. 1 is a front elevational view of a road roller of the present invention, and illustrates two roller drums thereof in broad-track or laterally offset relationship.
Figure 2:
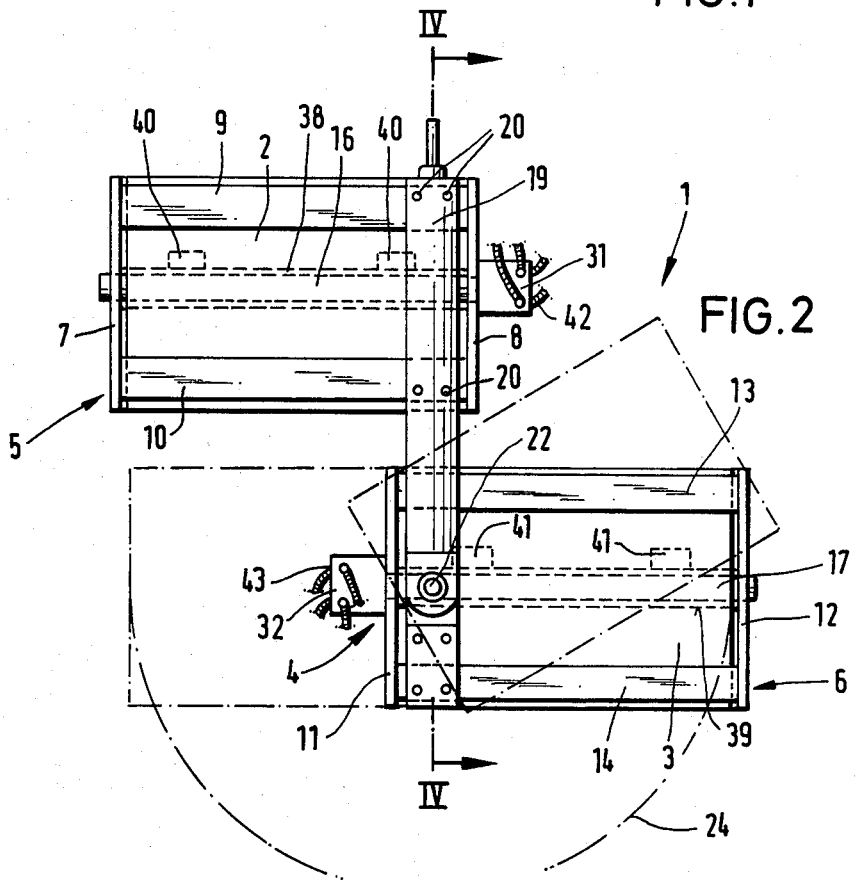
FIG. 2 is a top plan view of the road roller of FIG. 1, and illustrates a carrier spanning and secured to a frame associated with each roller drum with one end of the carrier being fixed to its associated frame by a vertical pivot pin passing through the axis of rotation of the one roller drum and through the longitudinal axis of the carrier.
Figure 3:
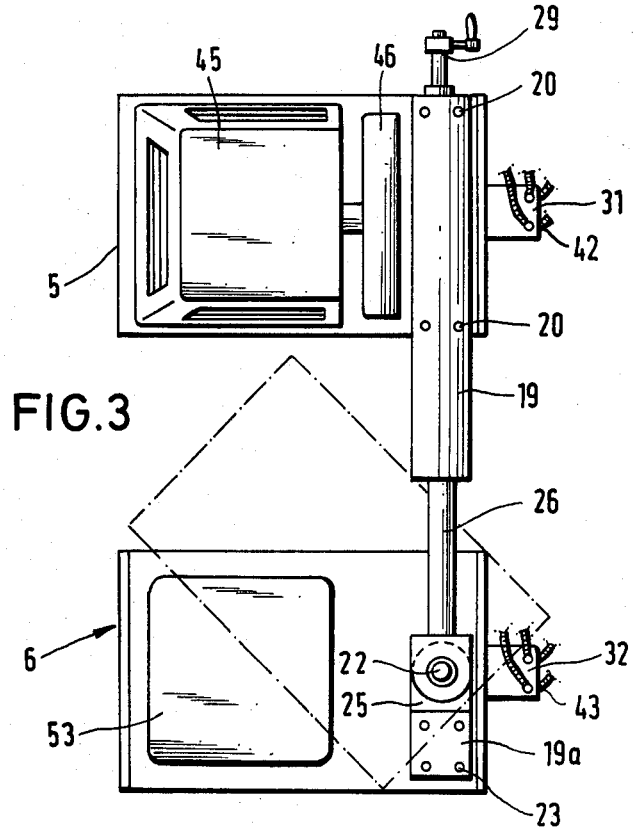
FIG. 3 is a top plan view of the road roller similar to FIG. 2 and illustrates the carrier in its extended position to space the roller drums a considerable distance away from each other.

A novel road roller constructed in accordance with the invention is generally designated by the reference numeral 1 (FIG. 2) and includes two roller drums 2, 3 of which the roller drum 3 is pivoted for movement between the solid and outline positions thereof (FIG. 2) by means of a vertical or perpendicular pivot or axle 4. The drums 2, 3 are carried by respective frames 5, 6 which include depending lateral supporting plates 7, 8 and 11, 12, respectively. The lateral supporting plates 7, 8 and 11, 12 are welded or otherwise fixed to angular frame members 9, 10 and 13, 14, respectively. The lateral supporting plates 7, 8 rotatably journal a shaft 16 of the drum 2, while the lateral supporting plates 11, 12 rotatably support a longitudinal shaft 17 of the roller drum 3. The frame members 9, 10 and 13, 14 are positioned with their horizontal legs (unnumbered) above the drums 2, 3 (see FIG. 4). The frames 5, 6 are connected to each other through a longitudinal carrier 19 which is fastened to the frame members 9, 10 of the frame 5 by screws, bolts 20 or the like. The carrier 19 also lies above the frame member 13 (FIGS. 2 and 4) and is fixed by a pin 22 of the vertical axle 4 to a separate carrier part 19*a* of the carrier 19. The carrier part 19*a* (FIG. 4) is secured by bolts 23 to the frame member 14. The joint 4 or vertical pivot pin 22 has a vertical axis which passes through the axis of the longitudinal shaft 17 of the roller drum 3, as is clearly evident in FIGS. 2 and 4 of the drawings. The axle 4 or pin 22 is also positioned immediately adjacent an axial end portion (unnumbered) of the roller drum 3 immediately adjacent the lateral supporting plate 11 (FIG. 2). The roller drum 3 can therefore be pivoted about the pivot pin 22 between the phantom outline positions illustrated in FIG. 2 about an arc 24. In FIG. 3 the roller drums 2, 3 are shown in solid outline in their tandem relationship whereas the same solid lines in FIG. 2 illustrate the roller drums 2, 3 in their broad-track or lateral arrangement. However, between the two solid line illustrated positions of the drums in FIGS. 2 and 3, the drum 3 can be pivoted between the phantom outline positions of FIG. 2 for steering around curves of varying radiuses, approaching difficult areas from preselected angles, etc. As the angle of the axis of the shaft 17 varies relative to the axis of the shaft 16 from the parallel, the road roller 1 can be driven in larger or smaller curves, as necessitated by the particular work to be accomplished. Additionally, though the pin 22 provides pivoting in but one direction (a horizontal plane about a vertical axis), this joint may also be a universal joint to permit universal movement of the frame 6 and the roller drum 3 about all three axes.

Figure 4:
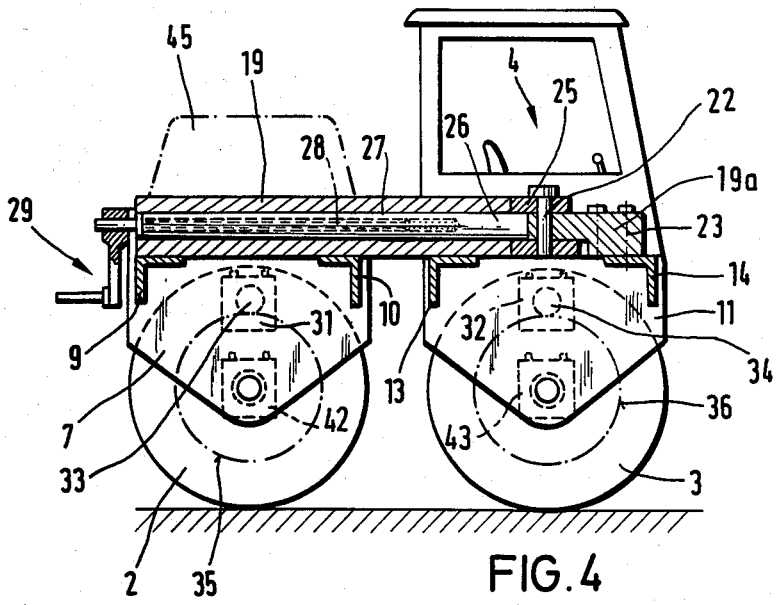
FIG. 4 is a cross-sectional view taken generally along line IV—IV of FIG. 2, and illustrates the manner in which the carrier is adjusted along its length by means of a threaded spindle and associated threaded bore.

The road roller 1 is preferably constructed such that the frames 5, 6 can be moved toward or away from each other (FIG. 3) through relative adjustment of the carrier 19 and the carrier part 19*a*. As is best illustrated in FIGS. 3 and 4, the carrier 19 is formed as a generally tubular member or cylinder and carries slidable therein a bush or rod 26 which is welded to plates 25 which are in turn connected by the pivot pin 22 to the carrier part 19*a*. The bush or rod 26 has an internally threaded bore 27 which threadably receives a threaded spindle 28, carrying at the free end thereof a crank 29. When the crank 29 is rotated, the spindle 28 similarly rotates and moves within the threaded bore 27. The spindle 28 is connected at its left-hand (FIG. 4) to the carrier 19 and thus, as the spindle 28 moves to the left, the carrier 19 moves to the left and vice versa. In this manner the distance between the drums 2, 3 can be increased (FIG. 3) or decreased (FIG. 4). This allows the roller drums 2, 3 to be positioned, for example, diagonally relative to each other with the roller drum 3 positioned as shown in FIG. 3 when the drums 2, 3 are spaced farthest from each other. This is particularly valuable when the roller drums 2, 3 are in their tandem arrangement (FIG. 3) with the free end of the roller drum 3 placed diagonally relative to and closely adjacent the roller drum 3 making it possible for the road roller to move along a relatively sharp right-hand or left-hand curve. The same arrangement is possible when the drums are laterally offset (FIG. 2) with, of course, the diagonal relationship of the drum 3 shown in FIG. 2 relative to the drum 2 permitting turning about either right or left curves.

Instead of the mechanical means 27, 28, etc. for varying the distance between the roller drums 2, 3 by longitudinal displacement of the carrier 19, the utilization of hydraulic means, such as a hydraulic piston/cylinder, can be utilized.

The roller drums 2, 3 each preferably include independent drive means 31, 32, respectively. The drive means 31, 32 engage pinions 33, 34, respectively, having two wheels or gears 35, 36 carried by the respective roller drums 2, 3. The drive mechanisms 31, 32 are controlled independently of one another, both as to speed and direction of rotation. Preferably hydraulic drive means, such as oil pumps and motors, are used as the drive means or fluid motors 31, 32.

Each roller drum 2, 3 also includes vibration means in the form of eccentric weights 40, 41 carried by sleeves 38, 39 of the respective drum shaft 16, 17. The sleeves 38, 39 are driven by drive means 42, 43 which are preferably hydraulic fluid motors. Obviously, mechanical drive means may be provided. In order to drive the hydraulic drive means 31, 32 , 42 and 43, an internal combustion engine 45 is provided in a conventional fashion upon the frame 5 of the roller drum 2. An internal combustion engine 45 drives a conventional hydraulic pump 46 from which the hydraulic motors 31, 32, 42 and 43 are driven via conduits 47, 48, 49 and 50. Also located in a convenient fashion upon the frame 6 is a seat 52 and a driver's cabin 53 with which is associated appropriate controls or levers 51 for controlling the drive means 31, 32 and the vibration mechanisms or means 42, 43. The control means 51 permit control of both the speed and direction as well as an adjustment to the number of vibrations by varying the number of revolutions of the sleeves 38, 39. The forward and backward direction and the steerage of the road roller 1 is controlled by simply adjusting the various speeds and the direction of rotation of the roller drums 2, 3 in a conventional fashion. The change in the direction and speed of the roller drums 2, 3 also serves as the mechanism for pivoting the roller drum 3 relative to the roller drum 2 about the pivot pin 22.

Although in a preferred embodiment of the invention as has been specifically illustrated and described herein, it is to be understood that minor variations may be made in the apparatus without departing from the spirit and scope of the invention, as defined in the appended claims.

I claim:

1. A road roller comprising a pair of rotatable roller drums, each roller drum having axially opposite end portions, means for establishing an axis of rotation of each roller drum, means for interconnecting said roller drums for relative pivotal movement between a first position at which said roller drums are generally in line with the direction of travel with the axes thereof generally parallel and a second position at which said roller drums are generally laterally offset relative to each other in the direction of travel, said pivotal interconnecting means includes a generally vertical pivot axis lying generally in the plane of the axis of rotation of one of said roller drums and adjacent one of the axial end portions of said one roller drum, a pair of frames positioned one relative to each of said one and second roller drums, said pair of frames each having opposite first and second end portions, a carrier disposed in the direction of travel and generally transversely to said axes of rotation in said first and second positions, said carrier having opposite end portions, one of said carrier end portions being connected at said vertical pivot axis by said pivotal interconnecting means to said one roller drum frame first end portion, and a second of said carrier end portions being permanently rigidly fixed to said second roller drum frame first end portion.

2. The road roller as defined in claim 1 wherein said second roller drum has one axial end portion immediately adjacent said one roller drum one axial end portion in both said first and second positions, and second axial end portions of said one and second roller drums are immediately adjacent each other in said first position and remotely spaced from each other in said second position.

3. The road roller as defined in claim 1 wherein said pivotal interconnecting means is a universal joint.

4. A road roller comprising a pair of rotatable roller drums, each roller drum having axially opposite end portions, means for establishing an axis of rotation of each roller drum, means for interconnecting said roller drums for relative pivotal movement between a first position at which said roller drums are generally in line with the direction of travel with the axes thereof generally parellel and a second position at which said roller drums are generally laterally offset relative to each other in the direction of travel, said pivotal interconnecting means includes a generally vertical pivot axis lying generally in the plane of the axis of rotation of one of said roller drums and adjacent one of the axial end portion of said one roller drum, a pair of frames positioned one relative to each of said one and second roller drums, said pair of frames each having opposite first and second end portions, a carrier disposed in the direction of travel and generally transversely to said axes of rotation in said first and second positions, said carrier having opposite end portions, one of said carrier end portions being connected at said vertical pivot axis by said pivotal interconnecting means to said one roller drum frame first end portion, a second of said carrier end portions being permanently rigidly fixed to said second roller drum frame first end portion, and means for selectively varying the length of said carrier to thereby selectively alter the distance between said roller drums.

5. The road roller as defined in claim 4 wherein said length varying means includes a pair of relatively slidable members, and hydraulic means for moving said slidable members relative to each other.

6. The road roller as defined in claim 4 wherein said length varying means includes a pair of relatively telescopically movable members.

7. The road roller as defined in claim 4 wherein said length varying means includes a pair of relatively telescopically movable members, and hydraulic means for moving said telescopic members relative to each other.

8. The road roller as defined in claim 4 wherein said length varying means includes a pair of relatively telescopically movable members, and screw thread means for moving said telescopic members relative to each other.

9. The road roller as defined in claim 1 including fluid motor means for drivably rotating at least one of said pair of roller drums.

10. The road roller as defined in claim 1 including means for independently drivably rotating each of said roller drums, and means for imparting vibratory motion to each of said roller drums.

11. The road roller as defined in claim 1 including fluid motor means for drivably rotating at least one of said pair of roller drums, internal combustion engine means for driving a hydraulic pump, and conduit means for communicating pressurized fluid from said hydraulic pump to said fluid motor.

12. A road roller comprising a pair of rotatable roller drums, each roller drum having axially opposite end portions, means for establishing an axis of rotation of each roller drum, means for interconnecting said roller drums for relative pivotal movement between a first position at which said roller drums are generally in line with the direction of travel with the axes thereof generally parallel and a second position at which said roller drums are generally laterally offset relative to each other in the direction of travel, said pivotal interconnecting means includes a generally vertical pivot axis lying generally in the plane of the axis of rotation of one of said roller drums and adjacent one of the axial end portions of said one roller drum, a carrier disposed in the direction of travel between and connected to said one and second roller drums, means for varying the length of said carrier along its longitudinal axis to thereby alter the distance between said roller drums, said carrier longitudinal axis in the plane of said vertical pivot axis whereby said one roller can move in two planes generally normal to each other, and means for pivoting said one roller drum for arcuate movement about said vertical pivot axis through an arc beyond 180°.

13. The road roller as defined in claim 12 wherein a second of said roller drums has one axial end portion immediately adjacent said one roller drum one axial end portion in both said first and second positions, and second axial end portions of said one and second roller drums are immediately adjacent each other in said first position and remotely spaced from each other in said second position.

14. The road roller as defined in claim 12 wherein said length varying means includes a pair of relatively telescopically movable members, and screw thread means for moving said telescopic members relative to each other.

15. The road roller as defined in claim 12 wherein said length varying means includes a pair of relatively slidable members, and hydraulic means for moving said slidable members relative to each other.

16. The road roller as defined in claim 12 wherein said length varying means includes a pair of relatively telescopically movable members, and hydraulic means for moving said telescopic members relative to each other.

17. The road roller as defined in claim 14 wherein a second of said roller drums has one axial end portion immediately adjacent said one roller drum one axial end portion in both said first and second positions, and second axial end portions of said one and second roller drums are immediately adjacent each other in said first position and remotely spaced from each other in said second position.

18. The road roller as defined in claim 15 wherein a second of said roller drums has one axial end portion immediately adjacent said one roller drum one axial end portion in both said first and second positions, and second axial end portions of said one and second roller drums are immediately adjacent each other in said first position and remotely spaced from each other in said second position.

19. The road roller as defined in claim 16 wherein a second of said roller drums has one axial end portion immediately adjacent said one roller drum one axial end portion in both said first and second positions, and second axial end portions of said one and second roller drums are immediately adjacent each other in said first position and remotely spaced from each other in said second position.

20. A road roller comprising a pair of rotatable roller drums, each roller drum having axially opposite end portions, means for establishing an axis of rotation of each roller drum, means for interconnecting said roller drums for relative pivotal movement between a first position at which said roller drums are generally in line with the direction of travel with the axes thereof generally parallel and a second position at which said roller drums are generally laterally offset relative to each other in the direction of travel, said pivotal interconnecting means includes a generally vertical pivot axis lying generally in the plane of the axis of rotation of one of said roller drums and adjacent one of the axial end portions of said one roller drum, and means for pivoting said one roller drum for arcuate movement about said vertical pivot axis through an arc beyond 90°.

21. The road roller as defined in claim 20 wherein a second of said roller drums has one axial end portion immediately adjacent said one roller drum one axial end portion in both said first and second positions, and second axial end portions of said one and second roller drums are immediately adjacent each other in said first position and remotely spaced from each other in said second position.

22. The road roller as defined in claim 20 including a carrier disposed in the direction of travel between said one and second roller drums, means for connecting said carrier to said roller drums, and means for selectively varying the length of said carrier to thereby selectively alter the distance between said roller drums.

23. The road roller as defined in claim 20 including a carrier disposed in the direction of travel between said one and second roller drums, means for connecting said carrier to said roller drums, means for selectively varying the length of said carrier to thereby selectively alter the distance between said roller drums, length varying means including a pair of relatively slidable members, and hydraulic means for moving said slidable members relative to each other.

24. The road roller as defined in claim 20 including a carrier disposed in the direction of travel between said one and second roller drums, means for connecting said carrier to said roller drums, means for selectively varying the length of said carrier to thereby selectively alter the distance between said roller drums, and said length varying means including a pair of relatively telescopically movable members.

25. The road roller as defined in claim 20 including a carrier disposed in the direction of travel between said one and second roller drums, means for connecting said carrier to said roller drums, means for selectively varying the length of said carrier to thereby selectively alter the distance between said roller drums, said length varying means including a pair of relatively telescopically movable members, and hydraulic means for moving said telescopic members relative to each other.

* * * * *